United States Patent [19]

Lieberman et al.

[11] 4,097,725

[45] Jun. 27, 1978

[54] GARMENT COUNTER

[76] Inventors: Frank David Lieberman; Herb Lou Goodman, both of 4676 Admiralty Way, both of Marina del Rey, Calif. 90291

[21] Appl. No.: 783,818

[22] Filed: Apr. 1, 1977

[51] Int. Cl.[2] ..... G06M 7/00

[52] U.S. Cl. ..... 235/92 PK; 235/92 V; 235/92 R; 250/222 R

[58] Field of Search ..... 235/92 PK, 92 V, 98 C; 250/222 R, 222 PC, 228

[56] References Cited

U.S. PATENT DOCUMENTS

| | | | |
|---|---|---|---|
| 3,692,985 | 9/1972 | Kalman | 235/92 PK |
| 3,813,523 | 5/1974 | Mohan et al. | 235/92 V |

*Primary Examiner*—Joseph M. Thesz
*Attorney, Agent, or Firm*—Bruce L. Birchard

[57] ABSTRACT

An accurate and high-speed garment counter for use in the garment and associated industries includes a hook-shaped wand terminating in a hanger-rail engaging slide and including adjacent the slide a light source directed upwardly and in optical conjunction with a light-sensing element, such as a photo-resistor or photo diode which shows a change in output, or pulse, each time the light beam is interrupted by the interposition, between the light source and the sensor, of the tip of a garment hanger, as the wand is slid along the bottom of the hanger rail. Digital counter means respond to the pulses from the light sensor to give a readout corresponding to the number of hangers, and, hence, the number of garments on the rail.

8 Claims, 3 Drawing Figures

GARMENT COUNTER

BACKGROUND OF THE INVENTION

1. Field of the Invention

This invention relates to the field of counters and, more specifically, to apparatus for counting garments.

2. Prior Art

In wholesale and retail garment manufacturing and distributing facilities large inventories of garments are frequently held, particularly just prior to the introduction of a line of garments. For various financial and sales reasons it is necessary to determine accurately, from time-to-time, the number of garments of a particular style or the number of garments overall held in inventory.

In the past it has been the practice to count these garments by visual inspection, a tedious and not too accurate method. Many times, low-paid help is assigned this task but the accuracy of the count is then even more suspect. Inaccurate counts of garments can lead to embarassing and costly business errors, and potential tax and other liabilities.

Therefore, it is a general object of this invention to overcome the problems set forth hereinbefore.

It is a further object of this invention to provide accurate and reliable means for counting garments.

It is a still further object of this invention to provide, for the counting of garments apparatus which can be operated by unskilled and low-paid workers without sacrificing counting accuracy.

SUMMARY OF THE INVENTION

Stated succinctly, a wand moved by an operator along the lower side of a hanger rail in a clothes rack, carries in its hooked forward end portion, in oppositely disposed positions, a light source and a light sensor. As the wand is moved along the hanger rail, the exposed tips of any hangers on the rail intercept the beam of light and produce an electrical pulse at the output of the sensor. A digital counter displays the total of such pulses, and, hence, the total of the hangers (and garments) counted, it being assumed that there is one garment per hanger.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description taken in conjunction with the accompanying drawings, in which:

DESCRIPTION OF THE PREFERRED EMBODIMENT

Figure 1:
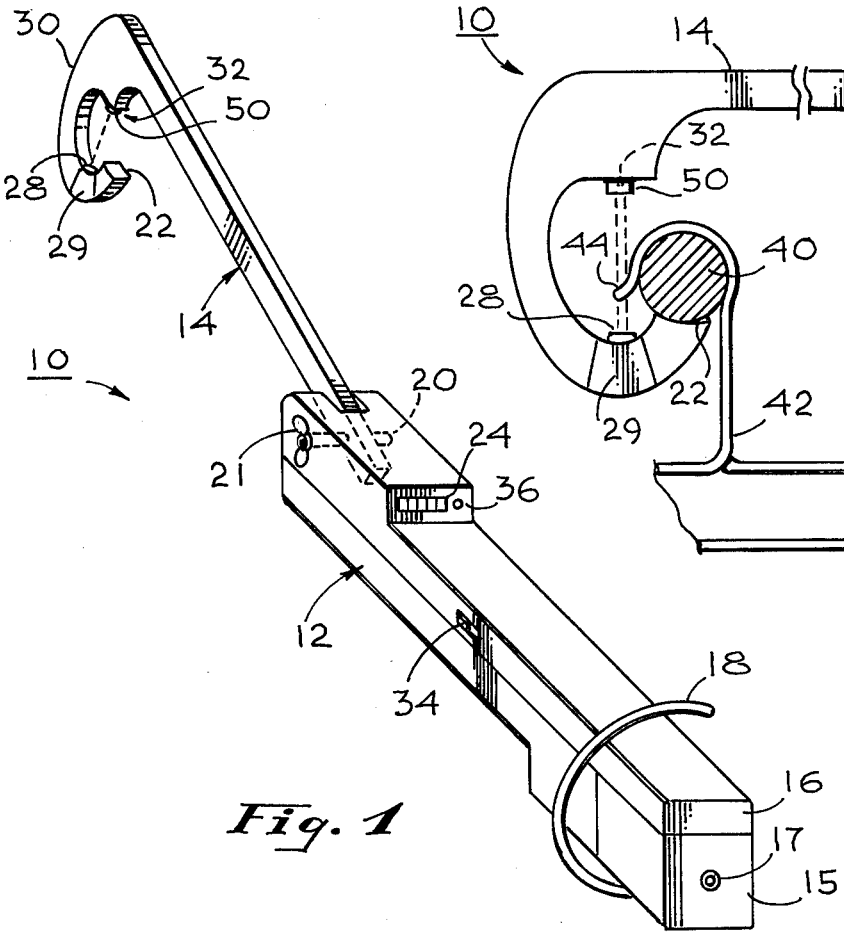
FIG. 1 is an orthogonal view of a garment counter according to the present invention.

In FIG. 1, counter 10 includes arm portion 12 and wand portion 14. Arm portion 12 is provided near one end 16 with strap 18 for securing arm portion 12 to the arm of the user of counter 10. Wand portion 14 is pivotally supported from arm portion 12 by pivot 20 which carries wing-nut 21 at one end to permit adjustable positioning of wand 14 with respect to arm 12 for easy use of counter 10 while assuring that slide 22 of wand portion 14 remains in engagement with the lower surface of a rail carrying garments, as can be seen more clearly in FIG. 2. Slide 22 may be removable and replaceable by a slide of appropriate size and shape to cooperate with rails of different diameters and cross-sectional configurations.

Arm portion 12 carries, preferably toward the pivot or hinge 20, the digital readout 24. Such positioning of readout 24 assures ease of reading the display, which may be an LED, in readout 24.

Arm portion 12 additionally carries the batteries for operating the electrical circuits of the counter. These batteries may be carried internally to arm 12 as in capsule 15 adjacent end 16 of arm 12. It is desirble that the batteries be placed longitudinally proximate to the strap 18 so that the weight of the batteries does not become multiplied, from the user's standpoint, by the length of a lever arm which would exist if the batteries were not proximate, longitudinally, to supporting strap 18. Recharging connector 17 may be provided in capsule 15.

Wand portion 14 carries, proximate to slide 22, a light source 28, which may be a grain-of-wheat lamp or a semi-conductor light source such as an LED. This light source is, preferably, mounted in an easily removable capsule 29, for replacement purposes.

In sensor section 30 of wand portion 14 a photo sensitive element 32, such as a photo-diode, is positioned and supported in alignment with light source 28. The positioning of light source 28 and sensor 32 must not only assure alignment therebetween but must also assure that, as slide 22 is moved along a hanger rail the tips of any hangers on the rail will intercept the light beam passing from source 28 to sensor 32. That is why source 28 should be proximate to rail-engaging slide 22. This necessary relationship is made more clear in FIG. 2. Electrical on-off switch 34 controls the electrical circuit of counter 10. Button 36 is provided for temporarily disabling the counting circuits without losing the count, as when moving counter 10 from one garment rack to another.

Figure 2:
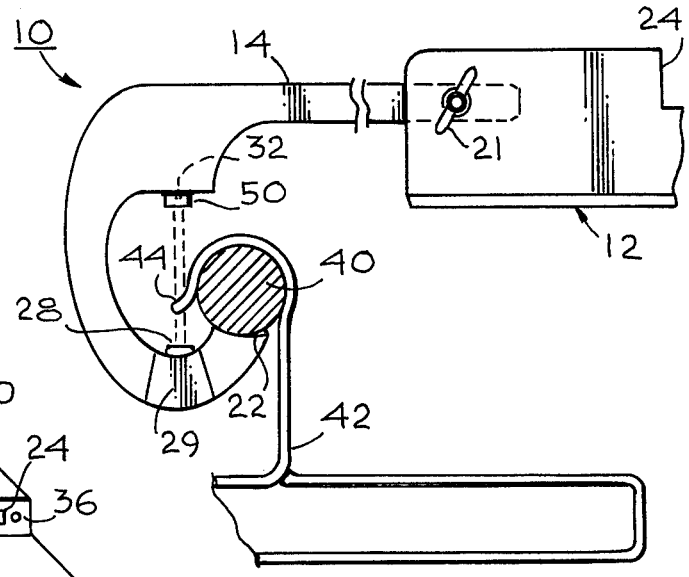
FIG. 2 is an elevation view, partially in schematic form, of a portion of the counter of FIG. 1, showing the counter of FIG. 1 in use; and, FIG. 3 is a schematic diagram of the electrical portion of the counter of FIG. 1, according to the present invention, with such diagram being in block form.

In FIG. 2, rail 40 carries garment hanger 42, thereon. Hanger 42 has tip 44 which extends beyond the diameter of rod 40, as shown. The beam of light from source 28 normally impinges on sensor 32 but as counter 10, on its slide 22, moves along rail 40, successive hanger tips 44 break the light beam, causing an electrical impulse which is amplified, counted and then displayed on readout 24.

Figure 3:
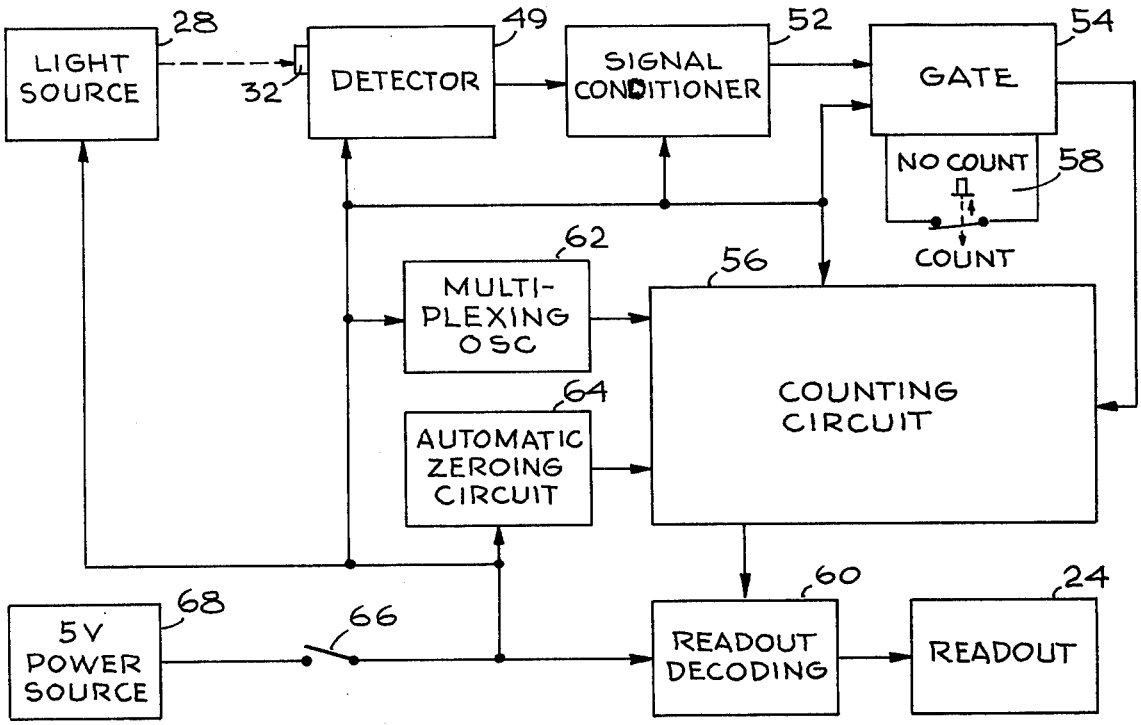

One circuit for achieving the desired counting is shown in functional-block form in FIG. 3. Light source 28, which may be a "grain-of-wheat" lamp that operates at 5 volts, d.c., emits light which impinges on sensor 32 in detector circuit 49. Sensor 32 may be a back-to-back photo-diode of the type, widely available commercially, which has its own internal focussing lens. This photodiode may be mounted in a hood 50 which prevents light from sources other than source 28, from impinging on the photodiode. Sensor 32 puts out electrical impulses corresponding to the light impulses which are incident on sensor 32 as counter 10 is moved along rail 40 and the light beam from source 28 is broken by the successive tips 44 of hangers 42. These impulses are amplified in detector 49 by means of an I-C chip type MM74C14 (available from Motorola, Inc.) coupled to sensor 32.

Electrical pulses from detector 49 are used to trigger a Schmitt trigger circuit in signal conditioner 52. The circuit of a Schmitt trigger is a standard circuit in the electronic art and need not be described here. The effect of the Schmitt trigger circuit is to produce pulses which correspond to the pulses from sensor 32 but are free of noise.

Gate 54 controls counting circuit 56 and includes "count-no-count" switch 58 having button 36 which, when depressed, permits counting circuit 56 to operate, but when not depressed, prevents pulse counting by circuit 56. Thus, if counter 10 is moved from place-to-place the total count on readout 24 remains the same, so long as button 36 is not depressed. The action of gate 54 can be achieved with commercially available I-C chip type MM74C00 (available from Motorola, Inc.)

Counting circuit 56 includes a large scale integrated circuit type MC14534 which is a 5-decade counter. Circuit 56 receives its input pulses from gate 54. The output pulses from circuit 56 appear on nine lines which are multiplexed to carry one number at a time for 1/1000th of a second each. The total number is read out every 5/1000th of a second.

Readout 24, which may be a 7-segment LED, type 5082 (available from Lightronix, Inc.), receives number readout information, on a multiplexed basis, from counting circuit 56 through readout decoder 60. Readout decoder 60 includes two commercially available I-C's, one a type MC14543 (available from Motorola, Inc.) and the other an RS-500/75492 (available from International Telephone and Telegraph Co.). The latter is used to determine which digit in readout 24 is to be illuminated and the former determines which of the 7-segments in that digit are to be illuminated, that is, which number between 0 and 9 is to appear, based on information derived from counting circuit 56.

Multiplexing oscillator 62 generates a clocking signal at 1000 Hz. and enables counting circuit and readout decoding circuit 60 to deliver a usable signal to readout 24. Oscillator 62 utilizes, to generate a 1 KHz signal, a portion of the I-C chip MM74C14 utilized in detector 49.

Automatic zeroing of readout 24, and of the circuits which drive it, is achieved by automatic zeroing circuit 64. Each time power to the counter is shut off, by switch 66 the counting circuit 56 is returned to zero count. To re-count, therefore, switch 66 is simply turned off and then on.

The operating voltage, in this case 5 volts d.c., is derived from a battery pack carried in capsule 15 of counter 10. Such battery pack may be made rechargeable, as by using nickel-cadmium batteries.

The electronic counting circuit described herein is well known, in most respects, to those skilled in the art and, from the information given herein could be assembled by one skilled in the art. Other counting circuits could be substituted.

While a particular embodiment of a garment counter has been shown and described it should be apparent to one skilled in the art that variations may be made upon that embodiment without departing from the spirit or scope of this invention. The claims which are appended hereto are intended to cover those variations.

We claim:

1. A counter for garments suspended, by means of hangers having tip portions, from a rail having a lower surface, including:

a wand, said wand having, at one extremity thereof, a slide portion, said slide portion being adapted to engage the lower surface of said rail;

a light source and a light sensor supported in said wand in aligned relationshp with each other to form a light path, said source and sensor being positioned in said wand so as to have said light path interrupted by said tip portions when said slide is moved along the lower surface of said rail; and, counting means coupled to said sensor for counting the interruptions of said light path by said tip portions as said wand is moved on said slide portion along said lower surface of said rail.

2. Apparatus according to claim 1 including, in addition, an arm portion pivotally connected to said wand, said arm portion including means for removably securing said arm portion to the arm of a user.

3. Apparatus according to claim 2 in which said counter is battery operated and said arm carries the batteries for such operation.

4. Apparatus according to claim 1 in which said counting means includes an electronic digital readout.

5. Apparatus according to claim 4 in which said readout includes at least one LED.

6. Apparatus according to claim 1 in which said sensor is a photodiode.

7. Apparatus according to claim 1 in which the extremity of said wand which carries said slide portion, said light source and said sensor, is hook-shaped.

8. Apparatus according to claim 1 including means for disabling said counting means without losing the count appearing on said readout.

* * * * *